US007598212B2

(12) United States Patent
Crouthamel et al.

(10) Patent No.: US 7,598,212 B2
(45) Date of Patent: Oct. 6, 2009

(54) LUBRICATING COMPOSITION SUITABLE FOR DIESEL ENGINES

(75) Inventors: Kevin Louis Crouthamel, Wycombe, PA (US); Vincent Mark Carey, Sewell, NJ (US); Peter Calcavecchio, Milford, NJ (US); Evelyn Nobles Drake, Bernardsville, NJ (US); Kevin John Kelly, Mullica Hill, NJ (US); Liehpao Oscar Farng, Lawrenceville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 678 days.

(21) Appl. No.: 10/876,972

(22) Filed: Jun. 25, 2004

(65) Prior Publication Data

US 2005/0014659 A1 Jan. 20, 2005

Related U.S. Application Data

(60) Provisional application No. 60/488,459, filed on Jul. 18, 2003.

(51) Int. Cl.
*C10M 137/10* (2006.01)

(52) U.S. Cl. ..... 508/436

(58) Field of Classification Search ..... 508/436
See application file for complete search history.

(56) References Cited

U.S. PATENT DOCUMENTS

| | | | | |
|---|---|---|---|---|
| 3,859,218 | A | 1/1975 | Jervis et al. | 252/32.5 |
| 4,130,494 | A * | 12/1978 | Shaub et al. | 508/408 |
| 4,514,311 | A | 4/1985 | Lu-Dai Sung et al. | 252/32.5 |
| 5,342,531 | A * | 8/1994 | Walters et al. | 508/272 |
| 5,354,484 | A * | 10/1994 | Schwind et al. | 508/192 |
| 5,585,029 | A | 12/1996 | Kim et al. | 508/274 |
| 5,763,372 | A | 6/1998 | Tersigni et al. | 508/436 |
| 6,310,011 | B1 * | 10/2001 | Karn et al. | 508/460 |

FOREIGN PATENT DOCUMENTS

| | | |
|---|---|---|
| EP | 1191088 | 3/2002 |
| EP | 1386957 | 2/2004 |

* cited by examiner

*Primary Examiner*—Walter D Griffin
*Assistant Examiner*—Frank C Campanell

(57) ABSTRACT

An improved lubricating composition suitable for diesel engines comprising a major amount of at least one oil of lubricating viscosity and a minor amount of an alkylamine-alkylphosphate additive. The alkylamine-alkylphosphate additive comprises from at least 1.25 equivalents of alkylamine to 1.0 equivalents of alkylphosphate.

9 Claims, No Drawings

LUBRICATING COMPOSITION SUITABLE FOR DIESEL ENGINES

This application claims the benefit of U.S. Ser. No. 60/488,459 filed Jul. 18, 2003.

FIELD OF INVENTION

The present invention relates to lubricating compositions. More particularly the invention relates to diesel engine lubricating compositions.

BACKGROUND OF INVENTION

Diesel engines may be classified broadly as slow speed, medium speed and high speed engines. Slow speed engines typically are two-stroke cycle engines operating in the range of about 57 to 250 rpm. Medium speed engines may be two-stroke or four-stroke cycle engines operating in the range of 250 to 110 rpm. High speed engines may be two stroke or four-stroke engines operating in the range of 1100 to 3000 rpm.

Slow-speed and medium-speed diesel engines usually run on residual fuels containing high levels of sulfur, for example, in the range of about 0.5 wt % to 5 wt % which can cause corrosive wear necessitating costly engine overhauls. High speed engines usually run on distillate fuels which also contain sulfur albeit somewhat lower levels than residual fuels. Lubricant formulators therefore use various additives to reduce such wear and enhance engine performance. Thus, metallic detergents are used in diesel oil lubricants to maintain engine cleanliness; and antioxidants are used to extend the lubricant's useful life. Various other additives may be employed in preparing a fully formulated oil. These include such things as anti-foamants, pour point depressants and the like.

The art of lubricating oil formulation, of course, has become increasingly complex not only because the performance requirements sought by engine manufacturers and users are becoming more stringent but because, as is known in the art, use of one type of additive in a lubricant composition can have a negative impact on the function of another type of additive in that composition. Consequently, there is always a need for improved lubricant compositions which need typically is met by extensive research.

The present invention has as an objective meeting the need for to improved diesel engine lubricating compositions.

Another object of the invention is to provide a lubricating composition that reduces corrosion and wear in diesel engines.

Yet another object of the invention is to provide lubricating compositions suitable for use in diesel engines operating on high sulfur fuels.

SUMMARY OF INVENTION

The present invention provides a lubricating composition comprising a major amount of at least one oil of lubricating viscosity and a minor amount of an alkylamine-alkyl phosphate additive. The alkylamine-alkyl phosphate comprises from at least 1.25 equivalents of alkyl amine to 1.0 equivalents of alkyl phosphate and an N/P wt ratio of at least 0.5.

In a preferred embodiment the alkyl phosphate is a mixture of mono and dialkyl phosphates represented by the general formulas I and II

I

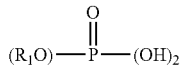

II

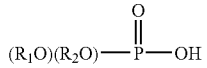

where $R_1$ and $R_2$ are the same or different alkyl groups of from 4 to about 30 carbon atoms.

DETAILED DESCRIPTION OF INVENTION

The lubricating compositions of the present invention are useful in diesel engines and especially slow-speed, two stroke marine diesel engines. These compositions comprise a major amount of at least one oil of lubricating viscosity. Thus natural and synthetic oils or mixtures thereof may be used. Natural oils include mineral oils, vegetable oils, solvent treated mineral oils and the like. Synthetic oils include polyalpha olefins, polyol esters, poly internal olefins, polyethylenes, propylenes, polybutenes, polyethyleneglycols, polypropyleneglycols, polyalkyleneglycols, their mixtures and the like, other functional fluids, such as alkylated aromatics, perfluoroalkylpolyethers, polyphenyl ethers, cycloaliphatics, phosphate esters, dialkyl carbonates, silicones, silahydrocarbons, phosphazenes, etc. In general the viscosity of the oil of the composition herein is in the range of about 5 to about 30 cSt at 100° C.

The composition of the present invention also comprise a minor, but effect amount, of an alkyl amine-alkyl phosphate additive. This additive comprises from at least 1.25 equivalents of alkyl amine to 1.0 equivalent of alkyl phosphate. Thus the ratio, in equivalents, of alkylamine to alkylphosphate will range from 1.25:1 to 20:1 and preferably from 1:5:1 to 5:1. The corresponding N/P ratio will then be 0.5:1 to 8:1 and preferably 0.6:1 to 2:1.

Suitable alkyl amines of the additive of the invention are linear and branched mono and dialkyl amines and mixtures thereof, having alkyl groups of from about 6 to about 50 carbon atoms, preferably from about 9 to 19 carbon atoms, and most preferably from about 11 to 14 carbon atoms. Non-hydrocarbon atoms, such as oxygen, sulfur, boron, silicon and phosphorus can be present in the branched hydrocarbon side chains.

Suitable alkyl phosphates are mono and dialkyl phosphates and mixtures thereof represented by the formulas I and II:

I

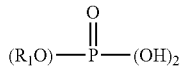

II

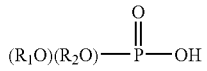

where $R_1$ and $R_2$ are the same or different alkyl groups of from about 4 to about 30 carbon atoms and preferably from 6 to 11 carbon atoms. Particularly preferred is a mixture of mono and dialkyl phosphates.

The alkylamine-alkyl phosphate additive typically is used in amounts ranging from about 0.05 wt % to 2.5 wt % based on the total weight of the lubricant composition.

The compositions of the present invention will include effective amounts at least one of metal detergents, antioxidants, dispersants, pour point depressants, demulsifiers, defoamants, and aromatic rich solubilizers.

Useful dispersants include succinimides, succinic acid esters, amides borated succinimides and the like. These typically will be present in an amount between about 0.10 to about 5.0 wt % based on the total weight of the compositions.

Suitable metal detergents include calcium and magnesium phenates, sulfonates, salicylates and the like. Typically these will be present from about 0.50 wt % to about 30.0 wt % based on the total weight of the compositions.

Suitable antioxidants include hindered phenols, arylamines and mixtures thereof. The amount of antioxidants typically will be in the range of 0.50 wt % to 2.0 wt % based on the weight of the composition.

The aromatic rich solubilizers that are useful in the composition of the invention include alkylated aromatics such as alkylated benzenes, alkylated toluenes, alkylated naphthylenes, alkylated biphenyls and alkylated diphenyl methane. The solubilizer will constitute about 0.20 wt % to about 15.0 wt % of the total composition.

Other components that optionally are included in the compositions include anti-foamants, pour point depressants, demulsifiers, high temperature stabilizers-antioxidants, ash or ashless dispersants, anti-wear additives, extreme pressure additives, dyes and the like.

In one embodiment of the invention a fully formulated marine oil lubricant is improved by adding to the oil the alkylamine-alkylphosphate additive described hereinabove. The additive is added in an amount ranging from 0.05 wt % to 2.5 wt % based on the weight of the composition.

EXAMPLES 1 AND 2

A fully formulated, commercially available marine oil (Oil #1) was used to prepare two oil compositions (Examples 1 and 2) of the invention by adding to Oil #1 0.05 wt % and 0.5 wt % respectively of Mobilad C-423, a $C_{11}$-$C_{14}$ monoalkylamine—$C_8$ mono- and dialkyl phosphate additive having 1.75 equivalents of amine per equivalent of phosphates. The commercially available oil included the components set forth in Table I.

TABLE I

| | |
|---|---|
| Base Oil | 74.4 wt % of a mixture of heavy neutral base oil and a thickening component. |
| Additive package | 25.6 wt % of a mixture of performance additive package including several overbased calcium detergents, dispersants, antioxidants, EP/anti-wear agents and defoamants. |

The Example 1 and 2 oils were then subjected to a series of performance evaluation tests. For comparative purposes Oil #1 was subjected to the same tests. The tests and the results are given in Table II.

TABLE II

| Example | | Comparative 1 Commercial Marine Oil #1 | Example 1 99.95% Marine Oil #1 0.05% Additive A | Example 2 99.5% Marine Oil #1 0.5% Additive A |
|---|---|---|---|---|
| Solubility Appearance | | clear & bright | clear & bright | clear & bright |
| 4 Ball Wear | WSD (mm) | 0.333 | 0.333 | 0.333 |
| 40 Kg/600 rpm/30 min./200° F. | K Factor | 0.57 | 0.57 | 0.57 |
| 4 Ball Wear | WSD (mm) | 0.45 | | 0.433 |
| 80 Kg/1200 rpm/60 min./200° F. | K Factor | 0.35 | | 0.25 |
| 4 Ball Wear | WSD (mm) | 0.567 | 0.500 | 0.489 |
| 120 Kg/60 rpm/60 min./200° F. | K Factor | 1.59 | 0.62 | 0.5 |
| 4 Ball EP (D2783) | LNS (Kg) | 160 | 160 | 160 |
| 30° C./10 sec./1760 rpm | Weld Ld (Kg) | 315 | 315 | 315 |
| | LWI | 65.3 | 66 | 65.3 |
| Cu Corrosion (D130-8) | 3 hrs/210° F./$H_2O$ | 1A | 1A | 1A |
| PDSC (Ramp 10° C./minute) | Onset Temp (° C.) | 248.2 | 252.3 | 253.5 |
| PDSC (Isothermal @ 210° C.) | Time (minutes) | 24 | 32.1 | 33.5 |
| Hot Tube Test (288° C./16 hours) | | 1 | 1 | 1 |
| Hot Tube (312° C./24 hours) | | 3.0 | 3.0 | 3.0 |
| Hot Tube Test (317° C./24 hours) | | 8.5 | 8.5 | 8.5 |

As illustrated in Table II, very good antioxidancy can be achieved with marine oils that utilize the amine-phosphate additive of the invention. As shown in Pressure Differential Scanning Calorimetry (PDSC), the onset temperatures of Examples 1 and 2 are 4-5 degrees higher than the result of Oil #1, the commercial oil.

The Four-ball wear test results indicate that Examples 1 and 2 have smaller wear scar diameters than Oil #1 under the severe test conditions (120 Kg load/600 rpm speed/60 minutes/200° F.) and almost equivalent wear scar diameter to Oil #1 under mild conditions (40 Kg/600 rpm). The K-factor is calculated from wear volumes and represents a better dimensionless measurement of relative wear protection. Clearly, under the severe conditions, both Examples 1 and 2 have much better protection than Oil #1 ([1.59−0.5]/0.5=218%, [1.59−0.62]/0.62=156%). The Four-ball EP test results are equivalent indicating that excellent load-carrying properties are maintained.

The Hot Tube Test is used to assess cleanliness features of engine oils under high temperature oxidation conditions. As exhibited, Examples 1 and 2 all have essentially equivalent cleanliness results of Oil #1.

EXAMPLE 3 AND 4

Three samples of the commercially available marine oil, (Oil #1), having the composition set forth in Table I were each top treated with 0.2 wt % of different alkylamine-alkylphosphate additives.

In Example 3 the additive was Mobilad C423, previously described. In Comparative Example 3 the additive was Irgalube 349 an alkylamine-alkylphosphate having substantially 1 equivalent of amine per equivalent of phosphate. In Example 4 the additive was Elco 301 in which the equivalents of amine to phosphate is in the range of about 1.25:1 to about 1:30:1. The oils were then subjected to an acid emulsion corrosion test. For comparative purposes Oil #1 was subjected to the same test. The test was conducted as follows: A cast iron ring was cut from a cylinder liner material, polished to remove oxidation and corrosion and commercial in 600 ml of oil. Then the oil was mixed for 1 hour after which 40 ml of $H_2SO_4$ was added at 1 ml/minute. Mixing was continued for 20 more minutes. The ring was removed, rinsed to a tared glass fiber filter with toluene, acetone and methanol. The filter and ring were dried and weighed. Also the corroded area of the polished face of the ring was determined using digital macro photographs. The results of the tests are given in Table III.

TABLE III

| Examples | Description | % Corrosion (on polished face) | Ring weight loss (centigrams) | Metal on filter (milligrams) |
|---|---|---|---|---|
| Comparative 2 | Reference Oil A | 12.5 | 21.3 | 20.6 |
| Example 3 | Oil A plus 0.2% Additive A | 0 | 0.1 | 10 |
| Comparative 3 | Oil A plus 0.2% Additive B | 0.5 | 16.2 | 52.3 |
| Example 4 | Oil A plus 0.2% Additive C | 0 | 0.5 | 11.4 |

Additive A = Mobilad C-423
Additive B = Irgalube 349
Additive C = Elco 301

EXAMPLE 5

A commercial marine test engine was operated for 1000 hrs using Oil #1 to which 0.5 wt % of Mobilad C-423 was added and the wear data for cylinder rings and liners was obtained. For comparative purposes the same data was obtained for Oil #1. The results are presented in Table IV.

TABLE IV

| | Comparative 5 | Example 5 | % Difference |
|---|---|---|---|
| Average Top Ring Wear Rate, mm/1000 hours | 0.66 | 0.62 | −6% |
| Maximum Top Ring Wear Rate, mm/1000 hours | 0.77 | 0.77 | 0% |
| Average Liner Diametral Wear Rate, Full Depth (Subto), mm/1000 hours | 0.023 | 0.024 | 4% |
| Max. Liner Diametral Wear Rate, Full Depth (Subto), mm/1000 hours | 0.134 | 0.126 | −6% |
| Ave. Liner Wear Rate, Top Only (Dimples), mm/1000 hours | 0.027 | 0.008 | −70% |
| Max. Liner Radial Wear Rate, mm/1000 hours | 0.099 | 0.042 | −58% |

What is claimed is:

1. A method comprising; enhancing corrosion and wear protection properties of a fully formulated marine diesel engine oil composition designed for use in engines burning high-sulfur containing residual fuels by composition having metal detergents from 0.5 wt % to 30 wt % of the composition wherein the metal detergents, calcium phenate, magnesium phenates, calcium sulfurates, magnesium sulfonates, calcium salicylate, magnesium salicylates, and any combination thereof adding to a natural oil from about 0.05 to 2.5 wt % of an alkylamine-alkylphosphate additive comprising at least 1.25 equivalents of alkylamine to 1.0 equivalents of alkylphosphate.

2. The method of claim 1 wherein the alkyl phosphate is a mixture of mono- and dialkyl phosphates having the formulas I and II

I

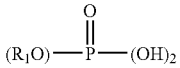

II

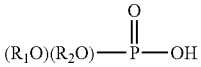

where R1 and R2 are the same or different alkyl groups of from about 4 to about 30 carbon atoms.

3. The method of claim 2 wherein the alkyl amine is selected from linear and branched mono- and dialkyl amines and mixtures thereof having about 6 to 50 carbons in the alkyl group.

4. The composition of claim 3 wherein the alkylamine-alkylphosphate additive comprises 1.5 to 5 equivalents of alkylamine per equivalent of alkylphosphate.

5. A method for reducing corrosion and wear in diesel engines operating on high sulfur fuels, the method comprising lubricating the engine with a lubricating composition comprising a major amount of a natural oil of lubricating viscosity and from about 0.05 to 2.5 wt % of an alkylamine-alkylphosphate additive comprising from at least 1.25 equivalents of alkylamine to 1.0 equivalents of alkylphosphate.

6. The method of claim 5 wherein the alkyl phosphate is a mixture of mono- and dialkyl phosphates having the formulas I and II

I

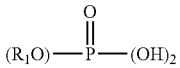

II

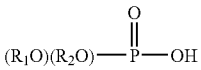

where R1 and R2 are the same or different alkyl groups of from about 4 to about 30 carbon atoms.

7. The method of claim 6 wherein the alkyl amine is selected from linear and branched mono- and dialkyl amines and mixtures thereof having about 6 to 50 carbons in the alkyl group.

8. The method of claim 7 wherein the alkylamine-alkylphosphate additive comprises 1.5 to 5 equivalents of alkylamine per equivalent of alkylphosphate.

9. The method of claim 1 wherein the high sulfur residual fuels have a sulfur content in the range of 0.5 wt % to 5 wt %.

* * * * *